US005573303A

United States Patent [19]

Doerner

[11] Patent Number: 5,573,303

[45] Date of Patent: Nov. 12, 1996

[54] CHAIR SEAT TILTING MECHANISM

[75] Inventor: Frank Doerner, Kitchener, Canada

[73] Assignee: Doerner Products Ltd., Waterloo, Canada

[21] Appl. No.: 441,772

[22] Filed: May 16, 1995

[51] Int. Cl.[6] ..... A47C 1/032

[52] U.S. Cl. ..... 297/300.5; 297/303.4; 297/319

[58] Field of Search ..... 297/300.2, 300.4, 297/300.5, 303.3, 303.4, 319, 317, 322

[56] References Cited

U.S. PATENT DOCUMENTS

| | | | |
|---|---|---|---|
| 2,471,024 | 5/1949 | Cramer | 297/300.5 |
| 4,966,411 | 10/1990 | Katagiri et al. | 297/300.5 X |
| 4,988,145 | 1/1991 | Engel | 297/300.5 X |
| 5,150,948 | 9/1992 | Völkle | 297/300.5 |
| 5,423,594 | 6/1995 | Hancock et al. | 297/300.2 |

FOREIGN PATENT DOCUMENTS

| | | | |
|---|---|---|---|
| 250995 | 1/1988 | European Pat. Off. | 297/301 |

*Primary Examiner*—Peter R. Brown
*Attorney, Agent, or Firm*—Wood, Herron & Evans, P.L.L.

[57] ABSTRACT

A chair seat tilting mechanism comprises a support for mounting to a chair spindle and a lever arm pivotally mounted at a pivot to the support, which lever arm is for mounting to a chair seat. A link arm is pivotally mounted at a pivot to the support and has a cam with a camming end positioned between the lever arm pivot mount and the link arm pivot mount. An extension of the link arm mounts to a chair back such that when a chair occupant leaning back on the chair back, the link arm pivots about the link arm pivot causing the cam to cam lever arm so that it pivots about its own pivot with the support. This results in the chair seat tilting forwardly.

8 Claims, 4 Drawing Sheets

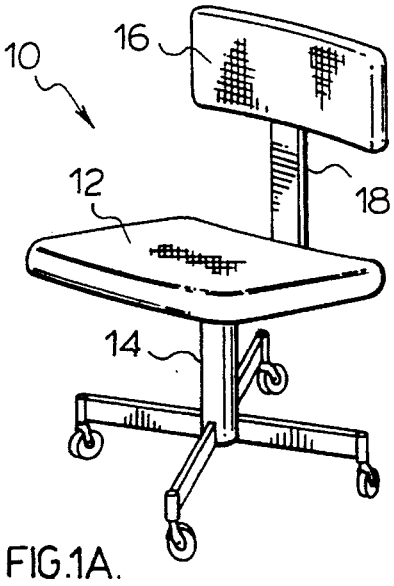
FIG.1A.
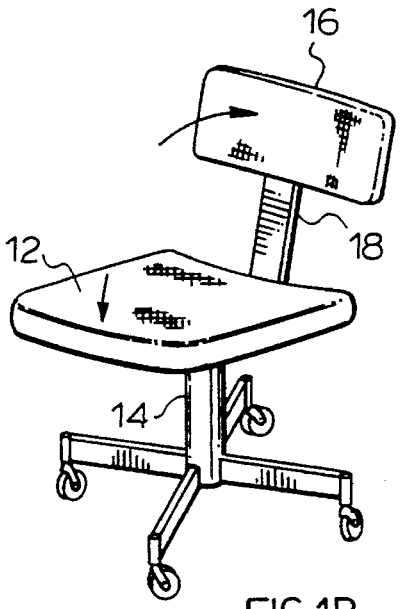
FIG.1B.
FIG. 2.
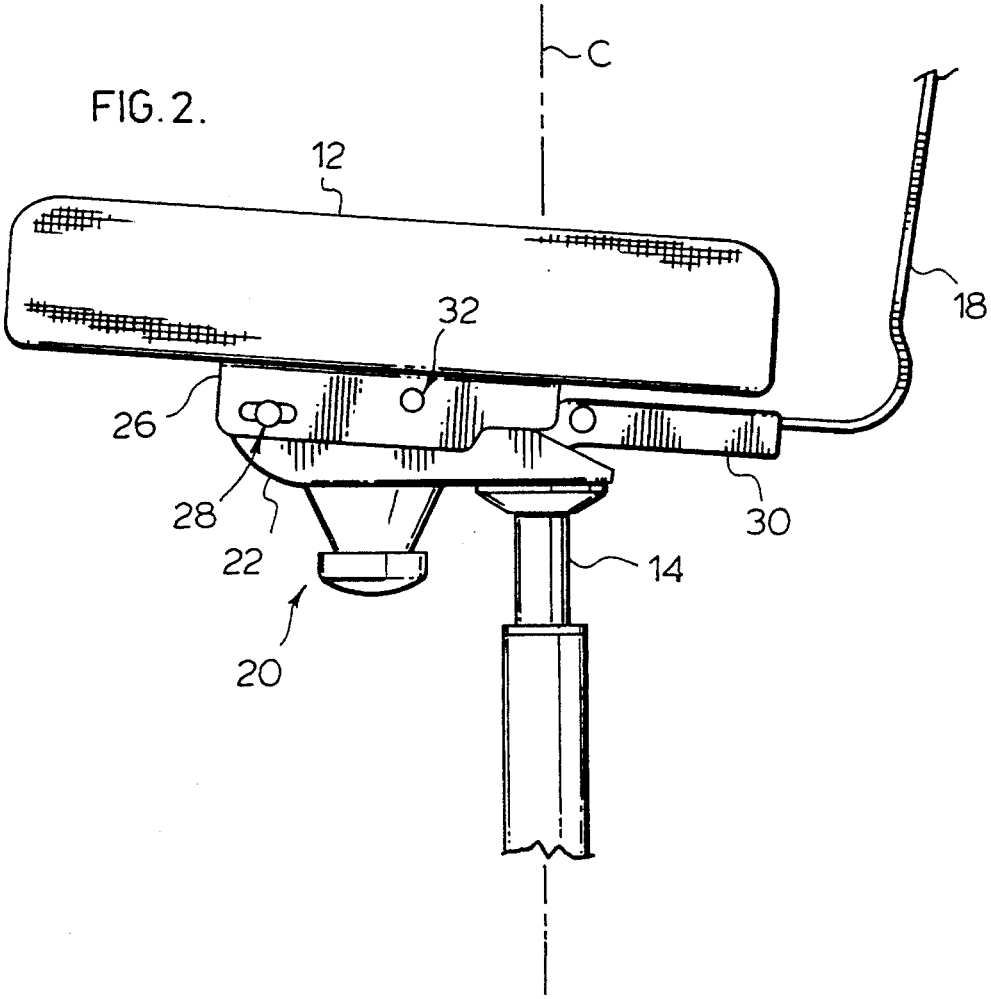

CHAIR SEAT TILTING MECHANISM

BACKGROUND OF THE INVENTION

1. Field of the Invention

The present invention relates to a chair seat tilting mechanism.

2. Description of the Related Art

Office chairs are known in which a chair seat is tiltably mounted to a chair spindle and a chair back is rigidly mounted with respect to the chair seat. With such a chair, when an occupant leans back in the chair, both the chair seat and back tilt backwardly together. In other known office chairs, the back tilts wholly or partially independently of the seat. When an occupant leans back in one of these chairs, both the chair seat and back will tilt backwardly, although not necessarily to the same degree. In any of these chairs, the backward tilt of the chair seat has the effect of reducing blood circulation in the legs and does not allow the occupant to assume a completely comfortable position.

This invention seeks to overcome drawbacks of the known prior art.

SUMMARY OF THE INVENTION

According to the present invention, there is provided a chair seat tilting mechanism comprising, a support for mounting to a chair spindle; a lever arm for mounting to a chair seat, said lever arm pivotally mounted at a pivot mount to said support such that, when said lever arm is mounted to said chair seat, pivoting said lever arm about said lever arm pivot mount tilts said chair seat forwardly; a link arm pivotally mounted to said support at a pivot mount, said link arm having a camming end located at one side of said link arm pivot mount such that said camming end is positioned for camming said lever arm at a point between said lever arm pivot mount and said link arm pivot mount, said link arm for supporting a chair back at a side of said link arm pivot mount which is opposite from said one side such that when said chair back is tilted backwardly, said camming end is raised thereby pivoting said lever arm about said lever arm pivot mount in order to tilt said chair seat forwardly.

BRIEF DESCRIPTION OF THE DRAWINGS

In the drawings which disclose an example embodiment of the invention:

FIGS. 1*a* and 1*b* are perspective views of an office chair incorporating the chair seat tilting mechanism of this invention, FIG. 2 is a side view of a portion of the chair of FIG. 1*a*.

DETAILED DESCRIPTION OF THE PREFERRED EMBODIMENTS

Figure 3:
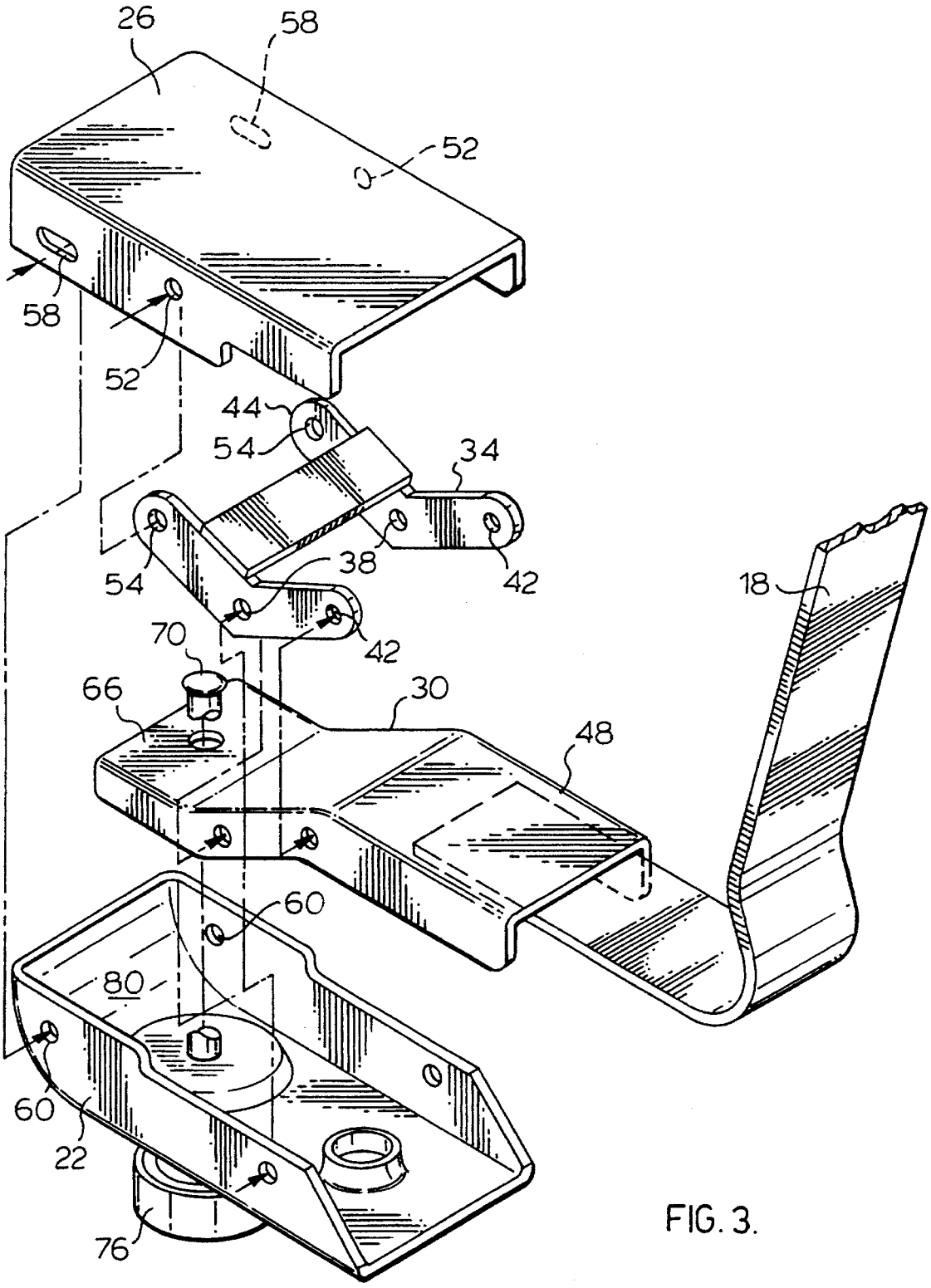
FIG. 3 is an exploded perspective view of a portion of FIG. 2.

Referencing FIG. 1*a*, a chair 10 comprises a chair seat 12 mounted above a spindle 14. A chair back 16 is mounted behind seat 12 by a chair back mounting arm 18. Referencing FIG. 1*b*, as will become apparent hereinafter, when seat back 16 is tilted backwardly, chair seat 12 tilts forwardly, as indicated by the arrows in FIG. 1*b*.

Turning now to FIG. 2, the chair seat adjusting mechanism of this invention is indicated generally at 20. The mechanism 20 comprises a support 22 mounted to the chair spindle 14 for rotation about the longitudinal axis C of the spindle. A lever arm 26 is pivotally mounted at pivot 28 to the support member 22. The lever arm is mounted to chair seat 12 by any conventional means. A link arm 30 is pivotally mounted at a pivot 32 to the support member 22. The link arm is mounted to the chair back mounting arm 18.

Figure 4:
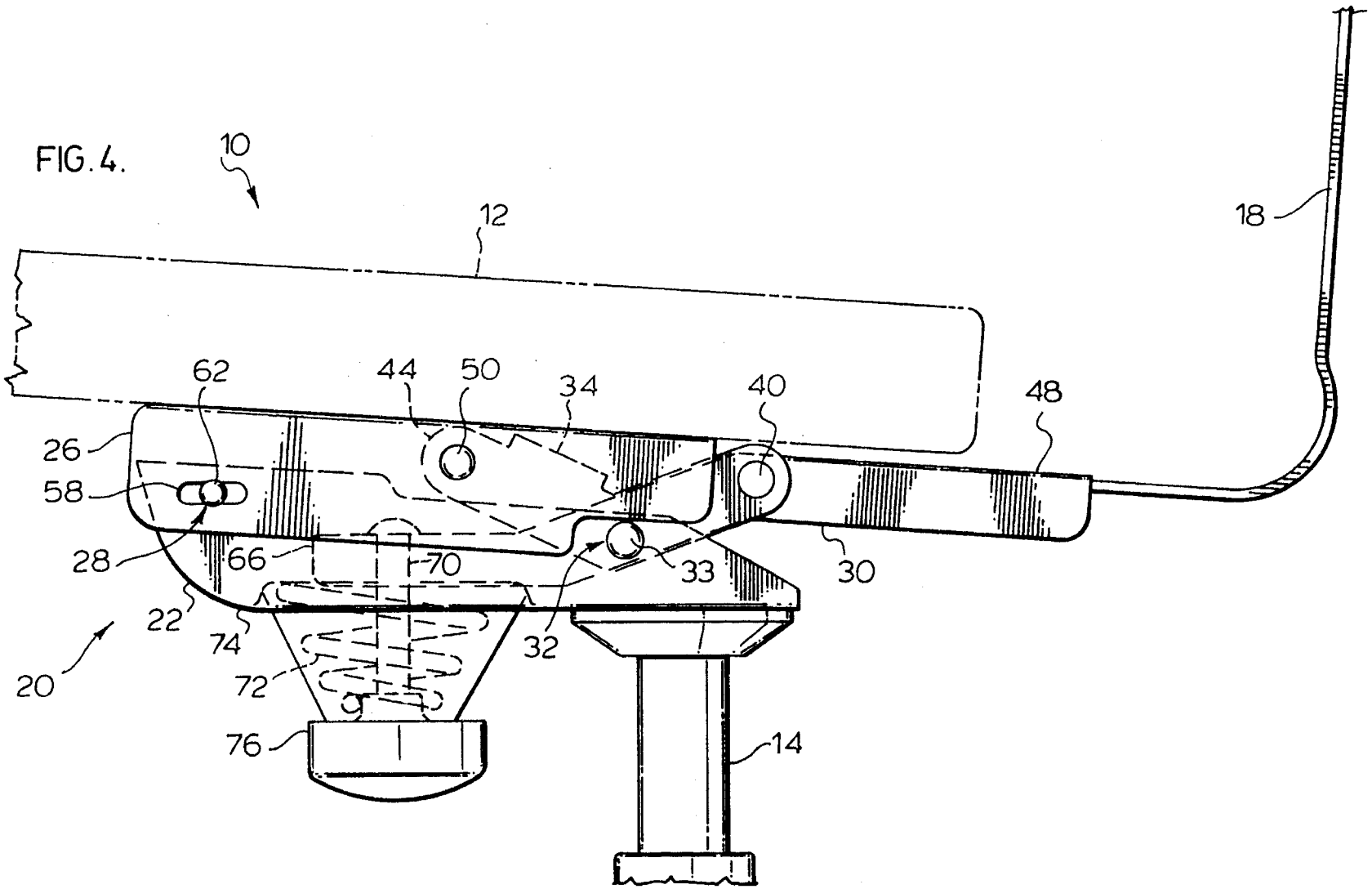
FIG. 4 is a side view of a portion of the chair of FIG. 1*a*.

Turning to FIGS. 3 and 4, a cam 34 is rigidly mounted to link arm 30 by means of pivot pin 33 (FIG. 4) of pivot mount 32, which extends through openings 38 in the cam 34, and pin 40, (FIG. 4) which extends through openings 42 in the cam. Cam 34 has a camming end 44 for camming lever arm 26. As is apparent from FIG. 4, link arm 30 supports cam 34 such that the camming end 44 is positioned between the lever arm pivot mount 28 and the link arm pivot mount 32. This positions the camming end on the side of the lever arm pivot 28 which is more proximate the chair back 16. The link arm has a mountable extension 48 on the side of the link arm pivot mount 32 opposite to that of the camming end 44. The mountable extension mounts to the chair seat back mounting arm 18 by conventional means, such as a series of bolts. A pin 50 (FIG. 4) extends through openings 52 in the lever arm and openings 54 in the cam 34 in order to pivotally join the camming end to the lever arm.

The lever arm pivot mount 28 comprises a pair of elongate slots 58 in the lever arm 26, a pair of circular apertures 60 in support 14, and pin 62 (FIG. 4) which is received by the elongate slots and circular apertures.

The link arm has a further extension 66 extending on the side of the link arm pivot mount 32 opposite to that of the mountable extension 48. A biasing means acts between the further extension 66 and the support 22 in order to bias the lever arm to a rest position, which is the position shown in FIG. 4. The biasing means comprises a shaft 70 supported within an elongate opening 80 (FIG. 3) of the further extension 66 and a coil spring 72 ( FIG. 4 ) extending from side 74 ( FIG. 4 ) of support 14, which side is opposite to the side of the support facing link arm 30. The coil spring is compressed between side 74 of support 14 and a spring supporting knob 76 on shaft 70. Preferably shaft 70 is threaded into knob 76 so that the spring tension on the lever arm 30 may be adjusted by adjustment of knob 76.

Figure 5:
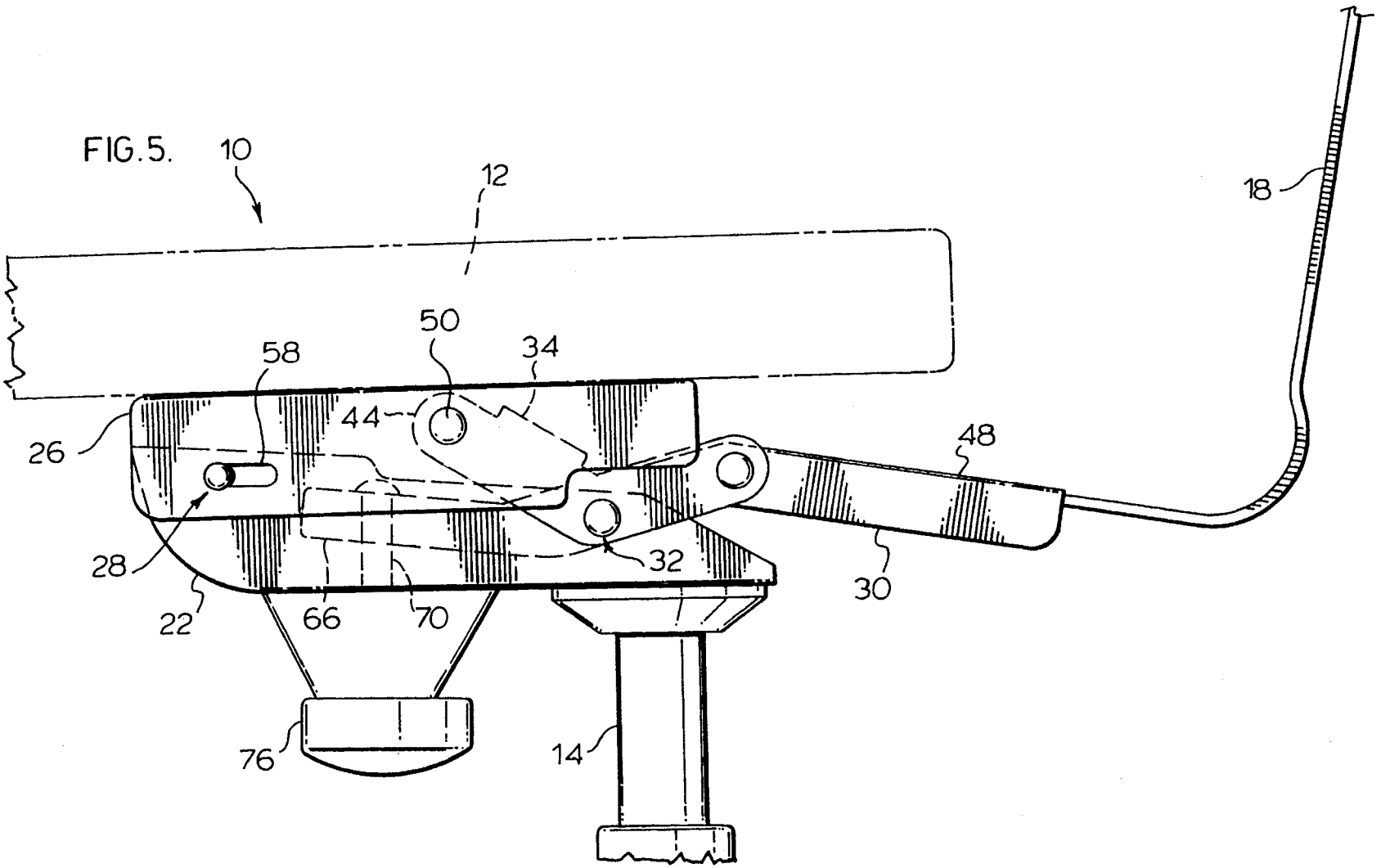
FIG. 5 is a side view of a portion of the chair of FIG. 1*b*.

The link arm acts as a cam activation means, as follows. If an occupant of chair 10 leans back in the chair so as to tilt the seat back 16 backwardly as indicated in FIG. 1*b*, the seat back mounting arm 18 causes link arm 30 to rotate in a clockwise direction about pivot mount 32 from its rest position shown in FIG. 4 to the posit ion shown in FIG. 5. The clockwise rotation of the link arm 30 causes the camming end 44 of cam 34 to pivot clockwise about pivot 32. The motion of the cam causes the lever arm to pivot counter-clockwise about its pivot mount 28 with support 22. Because the cam 34 is linked to the lever arm by pin 50, the pivoting of the cam about pivot 32 will draw the lever arm 26 toward the right. Slot 58 in the lever arm accommodates this translational motion of the lever arm. Since the lever arm 26 is affixed to the chair seat 12, the counter-clockwise pivoting of the lever arm imparts the same counter-clockwise rotation to the chair seat. This causes the front of the chair seat to tilt downwardly, as indicated in FIGS. 1*b* and 5.

When a chair occupant leans against the chair back 16, the clockwise torque imparted to the lever arm is resisted by a counter-clockwise torque imparted by spring 72. Thus, the occupant must overcome this resisting torque. As aforenoted, this resisting torque may be adjusted by adjustment of knob 76 on shaft 70. Also, when a chair occupant ceases to lean against the chair back, the torque imparted by spring 72 acts as a restoring torque to rotate the lever arm counter-clockwise about pivot 32 from the position of FIG. 5 back to the position of FIG. 4.

It will be appreciated that the elongate slot 80 through support 22 provides shaft 70 with the necessary freedom within support 22 as the lever arm rotates about pivot 32.

It will be recognised that the degree to which seat 12 is tilted forwardly with the backward tilting of the chair back may be controlled by the length of the cam 34 between pivots 32 and 50.

It will be apparent to those skilled in the art that the cam 34 could be integrally formed with lever arm 30. Additionally, cam end 44 could bear directly against a surface of the lever arm 26 rather than being pivotally mounted to the lever arm. Other modification will be apparent to those skill in the art and, therefore, the invention is defined in the claims.

What is claimed is:

1. A chair seat tilting mechanism comprising:

a support for mounting to a chair spindle;

a lever arm for mounting to a chair seat, said lever arm pivotally mounted at a pivot mount to said support such that, when said lever arm is mounted to said chair seat, pivoting said lever arm about said lever arm pivot mount tilts said chair seat forwardly;

a link arm pivotally mounted to said support at a pivot mount, said link arm having a camming end located at one side of said link arm pivot mount such that said camming end is positioned for camming said lever arm at a point between said lever arm pivot mount and said link arm pivot mount, said link arm for supporting a chair back at a side of said link arm pivot mount which is opposite from said one side such that when said chair back is tilted backwardly, said camming end is raised thereby pivoting said lever arm about said lever arm pivot mount in order to tilt said chair seat forwardly.

2. The mechanism of claim 1 wherein said camming end is pivotally joined to said lever arm.

3. The mechanism of claim 2 wherein said lever arm pivot mount comprises an elongate slot in one of said lever arm and said support and a hole in the other of said lever arm and elongate slot and a pin extending through said hole and said elongate slot, said elongate slot and pin permitting limited translational movement of said lever arm.

4. The mechanism of claim 1 wherein said link arm has an extension, said extension extending on said one side of said link arm pivot mount and including a biasing means acting between said extension and said support.

5. The mechanism of claim 4 wherein said biasing means comprises a shaft supported by said extension and a coil spring extending from a face of said support opposite said link arm, said coil spring being compressed between said face of said support and a support on said shaft.

6. A chair having a seat tilting mechanism, comprising:

a support mounted to a chair spindle;

a lever arm mounted to a chair seat, said lever arm pivotally mounted at a pivot mount to said support such that pivoting said lever arm about said lever arm pivot mount tilts said chair seat forwardly;

a link arm pivotally mounted to said support at a pivot mount, said link arm having a camming end located at one side of said link arm pivot mount such that said camming end is positioned for camming said lever arm at a point between a said lever arm pivot mount and said link arm pivot mount, said link arm supporting a chair back at a side of said link arm pivot mount which is opposite from said one side such that when said chair back is tilted backwardly, said camming end is raised thereby pivoting said lever arm about said lever arm pivot mount in order to tilt said chair seat forwardly.

7. The mechanism of claim 6 wherein said link arm has an extension, said extension extending on said one side of said link arm pivot mount and including a biasing means acting between said extension and said support.

8. The mechanism of claim 7 wherein said biasing means comprises a shaft supported by said extension and a coil spring extending from a face of said support opposite said link arm, said coil spring being compressed between said face of said support and a support on said shaft.

* * * * *